US008162158B2

(12) United States Patent
Northrup, Jr. et al.

(10) Patent No.: US 8,162,158 B2
(45) Date of Patent: Apr. 24, 2012

(54) SLIDE THROUGH SHELF

(75) Inventors: Robert L. Northrup, Jr., Machesney Park, IL (US); Richard A. Bennett, Machesney Park, IL (US)

(73) Assignee: Southern Imperial, Inc., Rockford, IL (US)

( * ) Notice: Subject to any disclaimer, the term of this patent is extended or adjusted under 35 U.S.C. 154(b) by 282 days.

(21) Appl. No.: 12/210,239

(22) Filed: Sep. 15, 2008

(65) Prior Publication Data

US 2010/0065523 A1 Mar. 18, 2010

(51) Int. Cl.
*A47F 5/08* (2006.01)

(52) U.S. Cl. ..... 211/90.02; 211/134; 211/90.01

(58) Field of Classification Search ..... 211/186, 211/87.01, 88.02, 90.01, 90.02, 119.003, 211/134, 153, 175, 189, 184; 108/60, 61, 108/42; 248/220.31, 235, 241, 247, 250
See application file for complete search history.

(56) References Cited

U.S. PATENT DOCUMENTS

| | | | | |
|---|---|---|---|---|
| 340,796 | A * | 4/1886 | Lorenze | 52/669 |
| 767,139 | A * | 8/1904 | Carli | 108/61 |
| 1,852,471 | A * | 4/1932 | Nelson | 108/60 |
| 2,269,303 | A * | 1/1942 | Backstrom | 211/189 |
| 2,642,330 | A * | 6/1953 | Armour | 312/257.1 |
| 4,228,743 | A * | 10/1980 | Crook | 108/31 |
| 4,376,521 | A * | 3/1983 | Walters | 248/206.3 |
| 4,934,642 | A * | 6/1990 | Baron et al. | 248/250 |
| 4,984,759 | A * | 1/1991 | Perlant | 248/99 |
| 5,346,078 | A * | 9/1994 | Ernetoft | 211/90.01 |
| D367,001 | S * | 2/1996 | Bright | D8/381 |
| 5,664,691 | A * | 9/1997 | Boivin-Paradis | 211/184 |
| 6,629,679 | B1 * | 10/2003 | Wilks | 248/251 |
| 6,920,989 | B2 * | 7/2005 | Lin | 211/87.01 |
| 2007/0227993 | A1 * | 10/2007 | Wilkinson | 211/186 |

FOREIGN PATENT DOCUMENTS

DE 4301290 A1 * 7/1994

* cited by examiner

*Primary Examiner* — Darnell Jayne
*Assistant Examiner* — Stanton L Krycinski
(74) *Attorney, Agent, or Firm* — Reinhart Boerner Van Deuren P.C.

(57) ABSTRACT

A slide through shelf is provided. A slide through shelf is illustrated mounted to a vertical retail wall. A slide through shelf as disclosed allows a user to selectably position the slide through shelf's supports in an infinite number of configurations. The slide through shelf may be quickly assembled to accommodate different types of loading and may be adjusted to provide customized product partitioning.

9 Claims, 4 Drawing Sheets

SLIDE THROUGH SHELF

FIELD OF THE INVENTION

This invention relates generally to retail shelving and particularly to retail shelving mounted to a vertical retail wall.

BACKGROUND OF THE INVENTION

Shelving has been in use since the earliest structures made by man. From organizing and displaying items in homes and offices to the use of shelves in stores or libraries, shelving is present in many aspects of society. Many shelving systems are modular, and may incorporate several components. A typical shelving system typically includes a shelf, and supports for vertically supporting the shelf. In many instances, the location of the supports is dictated and limited by the geometry and mounting locations of a vertical retail wall. Such limitation may result in the inefficient use of the shelving by reducing the amount, size, and stratification of retail merchandise that may be contained on a typical shelf.

There exists, therefore, a need in the art for art for a customizable shelving system in which a user may not only preassemble the system outside of the retail merchandise environment, but also have the ability to selectably adjust the amount and location of the shelf supports and optional partitions to an infinite number of locations as opposed to a finite number dictated by the overall shelving system assembly.

BRIEF SUMMARY OF THE INVENTION

The present invention has several aspects that may be claimed and stand as patentable independently and individually or in combination with other aspects, including but not limited to the following.

In one aspect, an embodiment of the invention provides a highly customizable adjustable shelf. A slide through shelf according to this aspect comprises a shelf and a plurality of support members, wherein the shelf passes through an opening of each of the plurality of support members and the plurality of support members are adapted to be selectably positioned along a length of the shelf and relative to one another. The plurality of support members may be adjusted to correspond to and support different sizes of retail merchandise.

In another aspect, an embodiment of the invention provides a quickly assembled and cost effective shelving and divider system. A slide through shelf according to this aspect comprises a vertical retail wall that has a plurality of apertures or slots, a shelf, and a plurality of support members mounted to the apertures or slots, wherein the shelf is mounted to each of the plurality of support members such that two adjacent support members in combination with the shelf define a retail merchandise region adapted to receive retail merchandise.

In yet another aspect, an embodiment of the invention provides a method for assembling a slide through shelf comprising the steps of selecting a plurality of support members and sliding a shelf through an opening of each of the plurality of support members. An additional step of this method may include mounting the slide through shelf to a vertical retail wall.

Other embodiments of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
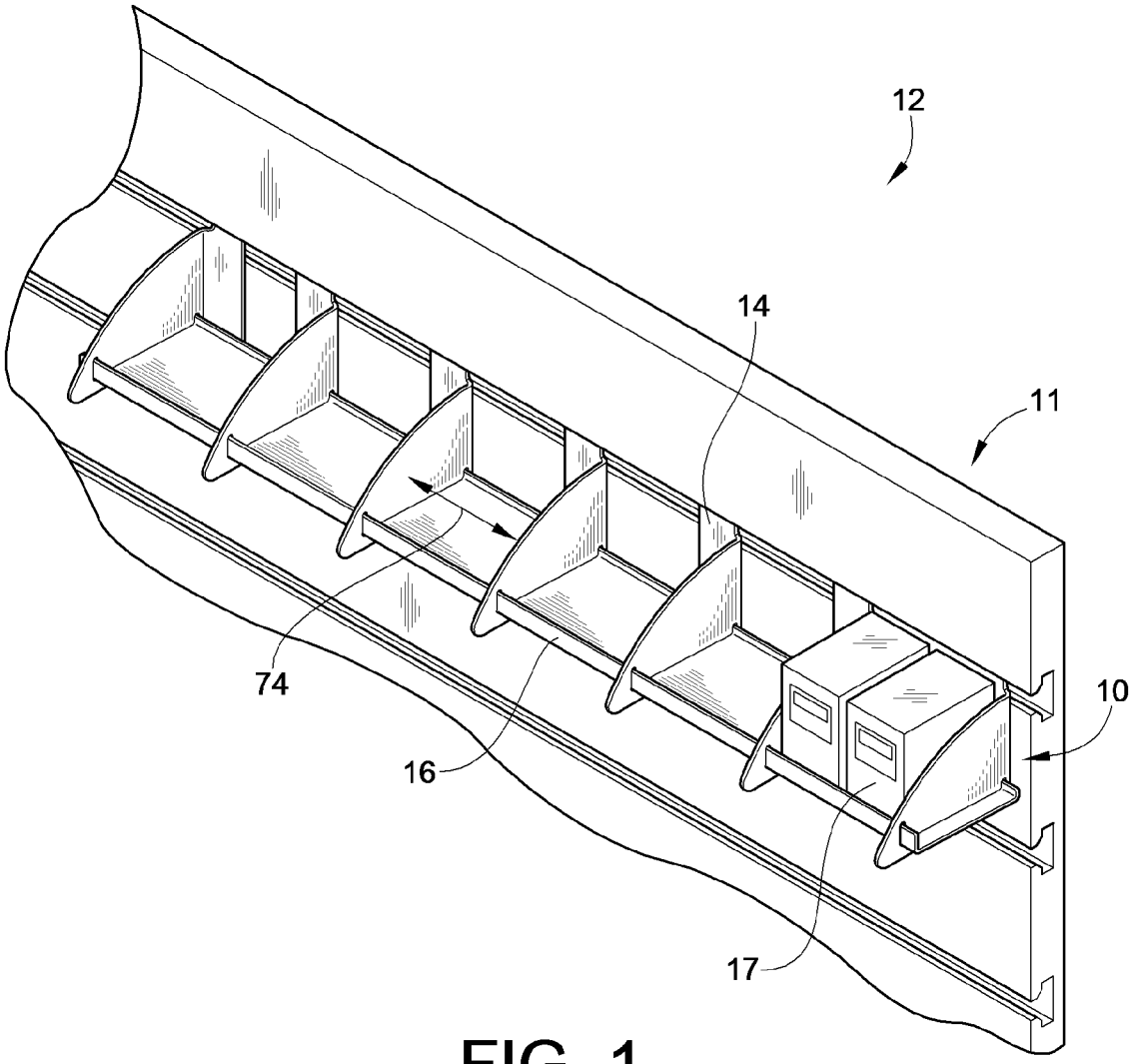
FIG. 1 is an exemplary embodiment of a slide through shelf installed on a vertical retail wall in accordance with the teachings of the present invention.

FIG. 1 illustrates an embodiment of a slide through shelf 10 installed on a vertical retail wall 11, together forming a retail shelving and divider system 12 for use in a typical retail environment. The slide through shelf 10 may be loaded with a variety of retail merchandise 17 ranging from packaged products such as over the counter pharmaceuticals to loose products such as assorted hardware, e.g. screws, nails etc. As illustrated, the slide through shelf 10 may be located at a height along the vertical retail wall 11 that is optimal for product identification by a typical consumer. The slide through shelf 10 may include a plurality of support members 14, and a shelf 16. As illustrated in FIG. 1, the vertical retail wall 11 is represented by a slatwall, however, the vertical retail wall 11 may also be a peg board, or other similar structure suitable for mounting the slide through shelf 10 thereto.

Figure 2:
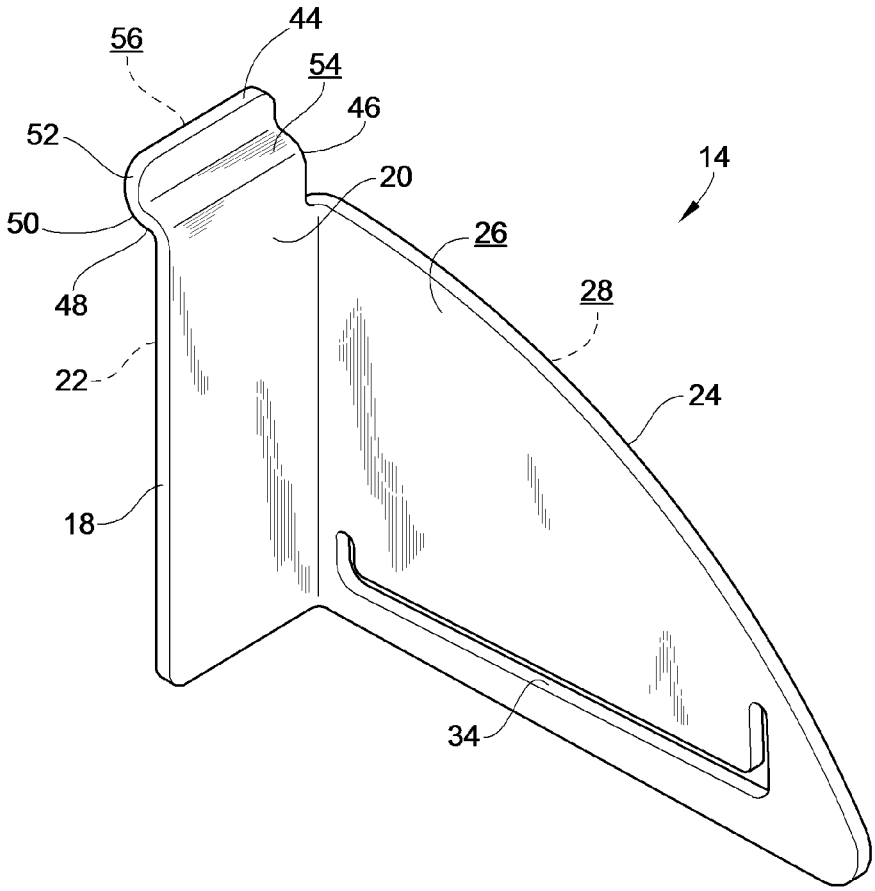
FIG. 2 is a perspective view of a support member of the slide through shelf of FIG. 1.

Turning now to the illustrated embodiment of FIG. 2, a support member 14 is illustrated. The support member 14 is comprised, generally, of a backing wall 18, a support wall 24, an opening 34, and a mounting flange 44. The support members 14 receive shelf 16 through openings 34 and vertically support the shelf 16, and also provides retail merchandise dividing or partitioning along the shelf 16 (see FIG. 1).

As shown in the illustrated embodiment, the backing wall 18 acts as a brace by stabilizing the support member 14 against the vertical retail wall 11. The backing wall 18 extends between front and rear faces 20, 22. The front face 20 is directed away from the vertical retail wall 11, and the rear face 22 is typically in contact with the vertical retail wall 11 when mounted to the vertical retail wall 11. In the illustrated embodiment, the backing wall 18 forms a generally right angle with the support wall 24. However, in other embodiments, the backing wall 18 is coplanar or generally transverse with the support wall 24, in order to facilitate mounting to various embodiments of vertical retail walls 11 and associated mounting hardware therewith. In preferred embodiments, the backing wall 18 has a length of between about 2" and about 16", a width of between about 1" and about 4", and a wall-thickness of between about 1/16" and about 1/4", but may deviate from these values in other embodiments.

Disposed above the backing wall 18 and integral thereto is the mounting flange 44. The mounting flange 44 functions to mount the support member 14 to a typical vertical retail wall 11. As illustrated, the mounting flange 44 has a first radius 46, an offset portion 48 extending generally horizontally from the first radius, a second radius 50 beginning at a distal end of the offset portion 48, and a retaining portion 52 extending generally vertically from a distal end of the second radius 50. The first radius 46, offset portion 48, second radius 50, and retaining portion 52 may be unitarily formed or supplied as a sub assembly. When unitarily formed, the first radius 46, offset portion 48, second radius 50, and retaining portion 52 extend between front and rear faces 54, 56. When unitarily formed, the front face 54 forms a single continuous surface with the front face 20 of the backing wall 18, and the rear face 56 forms a single continuous surface with rear face 22 of the backing wall 18. As will be discussed in more detail below, the mounting flange 44 in the illustrated embodiment is adapted to mount to a slatwall, however, the mounting flange 44 may be adapted to mount to other types of vertical retail walls 11 and the associated hardware therewith. The mounting feature may have an overall height of between about ½" and about 3", a width of between about 1" and about 4", and a thickness between about 1/16" and about ¼", but may deviate from these values in other embodiments.

In the illustrated embodiment, the support wall 24 has a general contoured profile and extends beyond the shelf 16 once the shelf is received by the opening 34. By virtue of its shape, the support wall 24 functions not only to support the shelf 16, but also provide retail merchandise 17 partitioning. The support wall 24 is generally at a right angle with respect to the backing wall 18, and extends between left and right faces 26, 28. The size of the contour of the support wall 24 is adjustable so as to vary the extent of retail merchandise 17 partitioning offered by the support member 14. In other embodiments, the support wall 24 is reduced in size and shape such that it provides minimal retail merchandise 17 partitioning. In further embodiments, the support wall 24 has a more regular profile, e.g. a rectangular profile, as opposed to a contoured shape or profile as illustrated. The support wall may extend transversely away from the backing wall between about 4" to about 26", but may deviate from this value in other embodiments.

Figure 3:
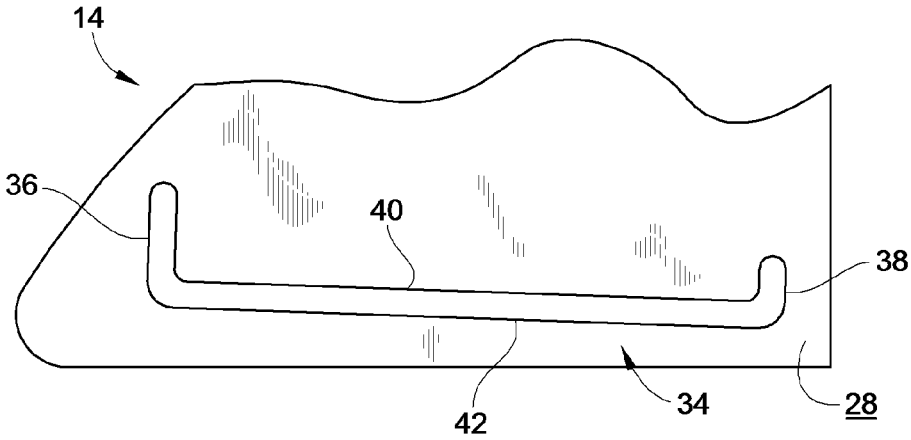
FIG. 3 is a partial view of an opening of the support member of FIG. 2.

Turning now to FIG. 3, the opening 34 is shown extending through left and right faces 26, 28 of the support wall 24. The opening 34 is adapted to receive a corresponding profile of the shelf 16, and once the shelf 16 is installed, the shelf 16 is limited to one axial degree of freedom along a longitudinal axis 74 (See FIG. 6) of the shelf 16. The opening 34 is bounded, at least in part, by front and rear edges 36, 38 in opposed lateral space relation to one another, and top and bottom edges 40, 42 in opposed spaced vertical relation to on another, and generally transverse to the front and rear edges 36, 38. As illustrated, the opening 34 has a generally "U" shaped profile, but can also be generally straight in other embodiments, whereby the front and rear edges 36, 38 have a maximum height equal to that of the top edge 40.

In one embodiment, the opening 34 is sized to provide a slip fit having minimal clearance with respect to the shelf 16 when the shelf 16 is received by the opening 34. As such, the opening 34 typically takes the shape of a profile of the shelf 16. When the shelf 16 is installed, it is substantially limited to displacement along longitudinal axis 74 (See FIG. 1) by virtue of the top, bottom, front, and rear edges 40, 42, 36, 38 acting as stops or barriers. The shelf may have some limited movement along other directions and still be considered to be "substantially limited to displacement along longitudinal axis 74." As will be discussed in further detail below, when the shelf 16 is loaded with retail merchandise 17, it will elastically deform to such an extent as to no longer maintain a slip fit with the opening 34, and thus be prevented from axial displacement along axis 74.

In the illustrated embodiment, the opening 34 is angled such that the bottom edge 42 of the opening 34 forms a shelf angle with the backing wall 18. By angling the opening 34, the shelf 16 will typically be similarly angled causing retail merchandise 17 situated upon the shelf 16 to be biased by gravity either forward and away from the vertical retail wall 11, or backward and toward the vertical retail wall 11. The shelf angle may range from between about 25° to about 155°.

Figure 4:
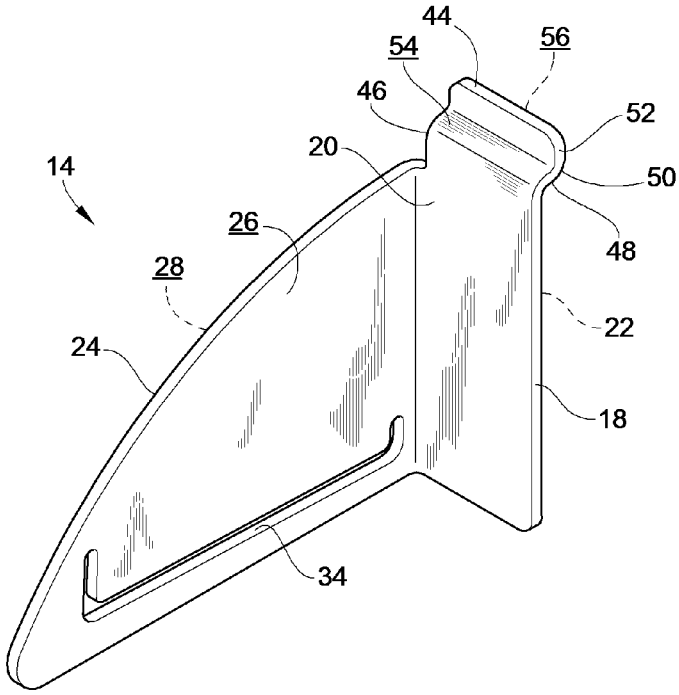
FIG. 4 is an alternative embodiment of the support member of the slide through shelf of FIG. 1.

Referring back to FIG. 2, the backing wall 18 extends generally to the left of the support wall 24 when viewing the front face 20 of the backing wall 18. Turning now to FIG. 4 and as will be explained in more detail below, in another embodiment, the backing wall 18 extends generally to the right of the support wall 24 when viewing the front face 20 of the backing wall 18. A slide through shelf 10 may incorporate either embodiment of support member 14 disclosed above, or a combination of the embodiments. In one embodiment, illustrated in FIGS. 1 and 6, the slide through shelf 10 uses several support members 14 having leftwardly extending backing walls 18 while moving from right to left along the length of the shelf 16, followed by a single support member 14 having a rightwardly extending backing wall 18 at the left most end of the shelf 16. In this embodiment, the support walls 24 of the support members 14 located at the extremities of the shelf 16 may function as end caps for the slide through shelf 10.

A typical support member 14 may be constructed of a formed plastic, metal, wood, or a combination thereof. Although illustrated as unitarily formed (i.e. as a single or one-piece construction), the support member 14 may be supplied as an assembly, wherein the backing wall 18, support wall 24, and mounting flange 44 are mechanically or adhesively joined to one another. The support member 14 may be transparent or opaque, but is not limited thereto.

Figure 5:
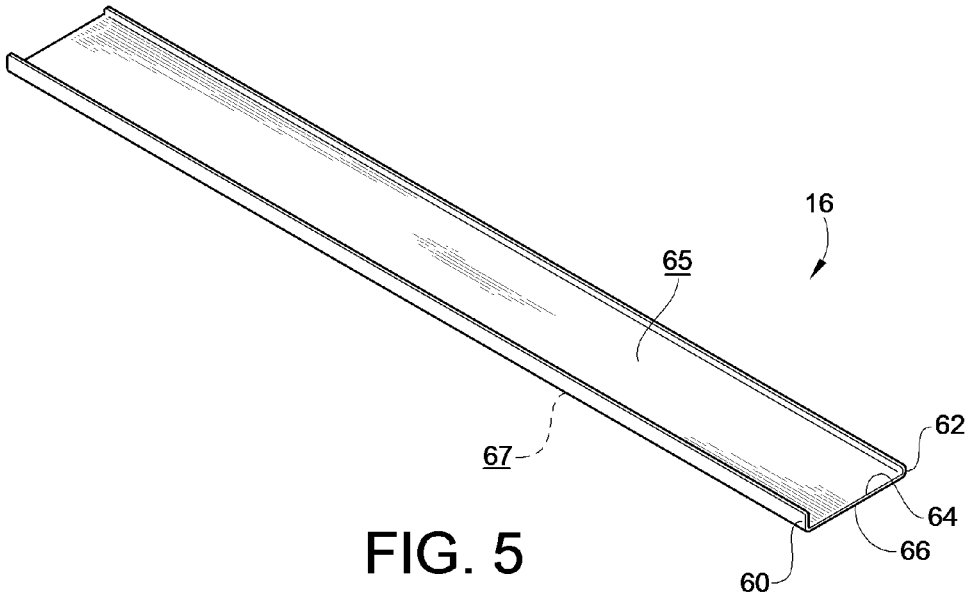
FIG. 5 is a perspective view of a shelf of the slide through shelf of FIG. 1.

Turning now to FIG. 5, a shelf 16 is illustrated. The shelf 16 supports the retail merchandise 17, and in combination with two adjacent support members 14 and the vertical retail wall 11, defines a retail merchandise region for the receipt of retail merchandise 17. The shelf profile has front and rear edges 60, 62 in opposed spaced relation to one another, and top and bottom edges 64, 66 in opposed spaced relation to one another and generally transverse to the front and rear edges 60, 62. The shelf extends between top and bottom surfaces 65, and 67. Top surface 65 is typically in contact with the retail merchandise 17, while bottom surface 67 is in contact with the bottom edge 42 of the opening 34 of each of the plurality of support members 14 supporting the shelf 16. This arrangement also prevents substantial vertical movement of shelf 16 within opening 34.

Although illustrated as having a generally "U" shaped profile, the shelf 16 may also have a generally planar profile in other embodiments. Also, the front and rear edges 60, 62 may extend downwardly past the bottom edge 66 in other embodiments, as opposed to extending upwardly past the top edge 66 as illustrated. Also in other embodiments, the front and rear edges 60, 62 may be generally transverse to the top and bottom edges 64, 66 as opposed to generally perpendicular as illustrated. Edges 60, 62 typically contact edges 36, 38 of opening 34 to substantially prevent lateral movement (i.e. front and back) of shelf 16.

The shelf may have an overall length of between about 6" to about 120", and a width of between about 2" to about 24". The shelf may be constructed of a formed plastic, metal or wood or a combination thereof. The shelf may be transparent or opaque, but is not limited thereto. Although illustrated as unitarily formed, the shelf may also be formed by mechanically joining several segments. However, the shelf 16 will typically be formed from extruded plastic.

Figure 6:
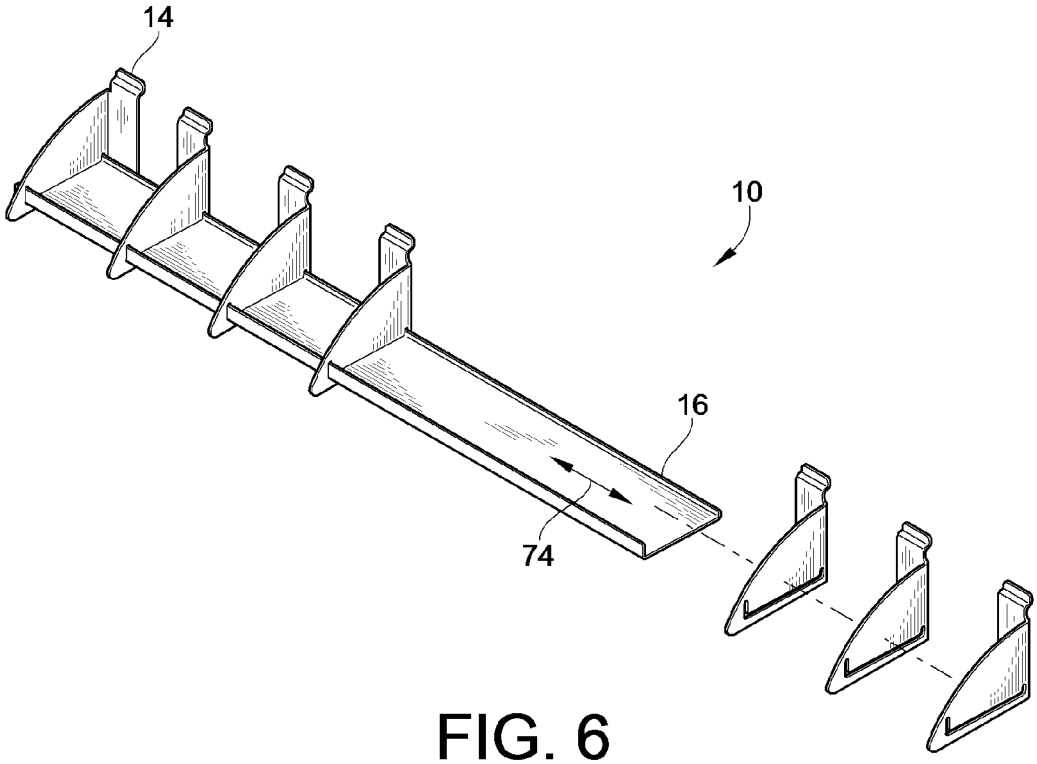
FIG. 6 is an assembly perspective view of the slide through shelf of FIG. 1.

Moving now to FIG. 6, the slide through shelf 10 is shown in a partially assembled view. The slide through shelf 10 is assembled by first determining how many support members 14 will be utilized. This determination may be based upon weight load intended to be carried by the shelf once loaded with retail merchandise 17, the desired retail merchandise 17 partitioning, a combination thereof, and/or other factors. Once an appropriate number of support members 14 has been selected, each support member 14 is successively installed by sliding the shelf 16 through the opening 34 of each of the support members 14 along axis 74. Once all of the selected support members 14 have been installed along the shelf 16, the support members 14 are then be selectably positioned along the longitudinal axis 74 of the shelf 16 to accommodate different sizes of retail merchandise 17 and to vary the support capabilities of the shelf 16.

As illustrated in FIG. 6, a support member 14 with a rightwardly extending backing wall 18 (See FIG. 4) is first to be installed on the shelf 16, then support members 14 with leftwardly extending backing walls 18 (See FIG. 2) are installed on the shelf 16. However, in other embodiments the shelf 16 is received by support members 14 having exclusively rightwardly or leftwardly extending backing walls 18, or a combination thereof.

Figure 7:
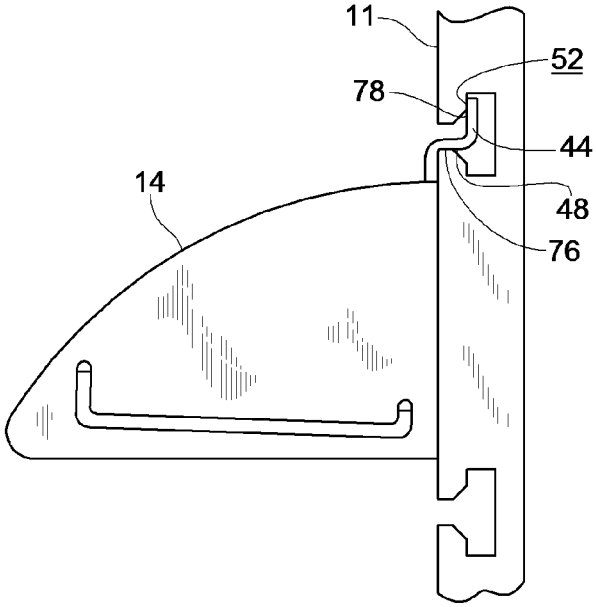
FIG. 7 is an end view of the slide through shelf of FIG. 1.

Turning now to FIG. 7, once the support members 14 have been installed and adjusted along the length of the shelf 16, the slide through shelf is then to be installed upon the vertical retail wall 11. In the illustrated embodiment, the mounting flange 44 locates and maintains the slide through shelf 10 at a height along the retail wall by virtue of the offset portion 48 engaging a generally horizontal surface 76 of the vertical retail wall 11. As illustrated, the retaining portion 52 then engages an interior surface 78 of the vertical retail wall 11, thus preventing the slide through shelf 10 from displacement away from the vertical retail wall 11.

Referring back to FIG. 1, as illustrated, the shelf 16 in combination with two adjacent support members 14 and the vertical retail wall 11 defines a retail merchandise region. Once the slide through shelf 10 has been installed upon the vertical retail wall 11, retail merchandise 17 is then loaded/unloaded out of each retail merchandise region. As described above, the shelf 16 forms an angle of greater than, less than or equal to 90° with the vertical retail wall 11 due to the shelf angle of the opening 34. The shelf angle thus allows the retail merchandise 17 to be biased by gravity forward or away from the front wall 60 of the shelf 16. When loaded, the shelf 16 is resilient enough to support the retail merchandise 17 but also has enough elasticity to slightly deform under the load of the retail merchandise 17. This deformation results in an interference fit between the opening 34 and the shelf 16, thus preventing the shelf 16 from displacement along the longitudinal axis 74 when the shelf is loaded.

The slide through shelf 10 is described above as being assembled sequentially by the steps of first determining an appropriate number of support members 14, then sliding and adjusting the support members 14 upon the shelf 16, and then installing the slide through shelf 10 on the vertical retail wall 11. However, the steps of the above process may be performed in other orders as well, for example by first installing all the support members 14 on the vertical retail wall 11 and then sliding the shelf 16 through the support members 14.

As described herein, the slide through shelf 10 allows a user to selectably position the support members 14 in an infinite number of positions along the length of the shelf 16. Moreover, the slide through shelf 10 has a quicker assembly time because the support members 14 not only support the shelf 16, but also serve as partitions, thus reducing the amount of components required for assembly. Additionally, the slide through shelf 10 may be supplied in a preassembled state, also reducing the assembly time required in a typical retail environment.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An adjustable shelf for retail merchandise, comprising:

a shelf having a generally U-shaped cross section perpendicular to a longitudinal axis of the shelf, the shelf having a bottom wall and front and rear walls extending upwardly from the bottom wall in opposed spaced relation;

a plurality of support members, wherein each of the plurality of support members includes a U-shaped opening for sliding reception of the shelf such that the opening completely surrounds the shelf and such that the shelf extends through the opening on either side of a vertical support wall of each of the plurality of support members, the vertical support wall being perpendicular to the longitudinal axis of the shelf;

a mounting portion formed on each of the plurality of support members, the mounting portion adapted to mount each of the plurality of support members to a vertical retail wall, the mounting portion providing a first sliding interface configured to permit sliding movement of each of the plurality of support members relative to the vertical retail wall in a direction parallel to the longitudinal axis of the shelf;

wherein the U-shaped opening provides a second sliding interface configured to permit sliding movement of each of the plurality of support members relative to the shelf in a direction parallel to the longitudinal axis of the shelf, such that each of the plurality of support members is simultaneously slidable relative to the vertical retail wall and relative to the shelf; and wherein the U-shaped opening of each of the plurality of support members has a bottom edge that is not parallel with a bottom edge of each of the plurality of support members such that the bottom wall of the shelf is not parallel to the bottom edge of each of the plurality of support members.

2. The adjustable shelf of claim 1, wherein each of the plurality of support members includes a backing wall extending generally perpendicular to the support wall thereof, such that each of the plurality of support members is generally L-shaped.

3. The adjustable shelf of claim 2, wherein the mounting portion is a mounting flange extending away from a top edge of the backing wall, the mounting flange having a generally S-shaped profile and configured to mount within a channel of a slatwall.

4. The adjustable retail shelf of claim 1, wherein the bottom wall of the shelf and a backing wall of each of the plurality of support members are at an angle of less than about ninety degrees.

5. The adjustable retail shelf of claim 1, wherein a portion of the support wall of each of the plurality of support members has an elliptical outer periphery.

6. The adjustable retail shelf of claim 1, wherein the shelf and each of the plurality of support members are formed from a transparent plastic material.

7. An adjustable retail shelving system for retail merchandise, comprising:

a vertical slatwall having a plurality of parallel adjacent channels formed therein;

a plurality of dividers, each having a mounting portion received within one of the parallel adjacent channels of the slatwall;

a shelf slidably received within an opening formed through a support wall of each of the plurality of dividers such that the opening surrounds the shelf and the shelf extends laterally beyond opposing sides of the support wall;

wherein each of the plurality of dividers is simultaneously slidable relative to the slatwall and relative to the shelf such that a size of a discrete retail merchandise containment space formed between adjacent ones of the plurality of dividers, the shelf, and the slatwall is adjustable when the mounting portion of each of the plurality of dividers is received within the one of the parallel adjacent channels;

wherein the opening of each of the plurality of dividers is U-shaped and the shelf has a corresponding U-shaped cross sectional profile;

wherein the shelf has a bottom wall and front and rear walls extending upwardly from the bottom wall in opposed spaced relation, wherein the front and rear walls each have a length that is shorter than a length of the bottom wall;

wherein the length of the rear wall is less than the length of the front wall; and wherein the shelf is received within the opening of each of the plurality of dividers such that the bottom wall of the shelf is disposed at an angle of less than about ninety degrees relative to the vertical slatwall.

8. The adjustable retail shelving system of claim 7, wherein each of the plurality of dividers includes a backing wall extending generally perpendicular to the support wall, the backing wall in sliding contact with the slatwall.

9. The adjustable retail shelving system of claim 8, wherein the mounting portion is a mounting flange extending away from the backing wall, and wherein each of the parallel adjacent channels has an upper lip and a lower lip separated by an opening, wherein the mounting flange contacts both the upper lip and the lower lip and extends into the opening.

* * * * *